US008123079B2

(12) United States Patent
Schroeder et al.

(10) Patent No.: US 8,123,079 B2
(45) Date of Patent: Feb. 28, 2012

(54) HOLSTER ASSEMBLY FOR A BAR GUN

(75) Inventors: A. A. Jud Schroeder, San Antonio, TX (US); Michael Romanyszyn, San Antonio, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 818 days.

(21) Appl. No.: 12/220,064

(22) Filed: Jul. 21, 2008

(65) Prior Publication Data

US 2009/0277927 A1 Nov. 12, 2009

Related U.S. Application Data

(60) Provisional application No. 61/126,935, filed on May 8, 2008.

(51) Int. Cl.
*B67D 1/16* (2006.01)

(52) U.S. Cl. ..... 222/108; 222/538

(58) Field of Classification Search ..... 222/108, 222/179.5, 109–111, 530, 538, 566, 571; 248/79, 312, 311.2; 220/719
See application file for complete search history.

(56) References Cited

U.S. PATENT DOCUMENTS

| | | | |
|---|---|---|---|
| 1,627,147 | A | 5/1927 | Clark |
| 1,947,329 | A | 2/1934 | Buttner |
| 2,478,586 | A | 8/1949 | Krapp |
| 2,682,386 | A | 6/1954 | Lindsay |
| 2,887,250 | A | 5/1959 | Zilk |
| 2,937,792 | A | 5/1960 | Firstenberg |
| 3,009,653 | A | 11/1961 | Hedeman |
| 3,013,701 | A | 12/1961 | Joschko |
| 3,108,779 | A | 10/1963 | Anderson |
| 3,326,520 | A | 6/1967 | Guenther |
| 3,619,668 | A | 11/1971 | Pinckaers |
| 3,643,754 | A | 2/1972 | Brandin et al. |
| 3,867,962 | A | 2/1975 | Gerrard |
| 3,963,317 | A | 6/1976 | Eignbrode et al. |

(Continued)

FOREIGN PATENT DOCUMENTS

GB 1 300 072 12/1972

OTHER PUBLICATIONS

Wunder-Bar Food & Beverage Dispensing Systems, Post-Mix Beverage Dispenser, Automatic Bar Controls, Inc., Rev.120508, p.

*Primary Examiner* — Lien Ngo
(74) *Attorney, Agent, or Firm* — Jackson Walker, LLP

(57) ABSTRACT

A bar gun holster assembly for receiving a bar gun. Bar guns are used to dispense beverages, typically soda and/or water therefrom. A holster assembly is a device that provides a place for a user to put the bar gun, nozzle first when it is not being used. Applicant's bar gun includes three components: a mounting plate, a holster portion, and a drain portion. The mounting plate is designed to attach to a support surface, such as the underside of a table or bar. The holster portion includes a cylindrical bar gun nozzle receiving member for receiving the nozzle of a bar gun slideably therein. The drain body is adapted to receive fluids dripping from the end of a nozzle and passing them to a drain line. Applicant's device includes walls that releasably couple the three members one to the other.

45 Claims, 6 Drawing Sheets

U.S. PATENT DOCUMENTS

| | | | |
|---|---|---|---|
| 4,098,295 | A | 7/1978 | Haytayan |
| 4,196,886 | A | 4/1980 | Murray |
| 4,219,046 | A | 8/1980 | West et al. |
| 4,390,224 | A | 6/1983 | Showman et al. |
| 4,433,795 | A | 2/1984 | Maiefski et al. |
| 4,469,389 | A | 9/1984 | Grabbe et al. |
| 4,497,421 | A | 2/1985 | Schilling |
| 4,519,635 | A | 5/1985 | McMath |
| 4,619,378 | A | 10/1986 | de Man |
| 4,635,824 | A | 1/1987 | Gaunt et al. |
| 4,637,527 | A | 1/1987 | Arrigoni |
| 4,711,374 | A | 12/1987 | Gaunt et al. |
| 4,821,921 | A | 4/1989 | Cartwright et al. |
| 4,921,140 | A | 5/1990 | Belcham |
| D309,232 | S | 7/1990 | Valiyee et al. |
| 4,986,449 | A | 1/1991 | Valiyee et al. |
| 5,033,648 | A | 7/1991 | Nakayama et al. |
| 5,042,692 | A | 8/1991 | Valiyee et al. |
| 5,524,452 | A | 6/1996 | Hassell et al. |
| 5,649,431 | A | 7/1997 | Schroeder, Jr. |
| 5,873,259 | A | 2/1999 | Spillman |
| 6,322,051 | B1 | 11/2001 | Salmela |
| 6,328,181 | B1 | 12/2001 | Schroeder et al. |
| 2008/0217357 | A1* | 9/2008 | Hecht ..... 222/108 |

* cited by examiner

SECTION A - A

HOLSTER ASSEMBLY FOR A BAR GUN

This is a utility patent application that claims the benefit of, priority from and incorporates herein by reference U.S. Provisional Application Ser. No. 61/126,935, filed May 8, 2008.

FIELD OF THE INVENTION

Holsters or holders for fluid dispensing apparatuses, including bar guns.

BACKGROUND OF THE INVENTION

Bar guns are typically comprised of a handle having a multiplicity of buttons thereon and a nozzle situated typically perpendicular to the handle, for dispensing a pre-selected fluid. Bar guns are well-known in the art. Nozzles of bar guns are typically cylindrical and are attached at a near end to the handle and have a fluid dispensing opening at a removed end thereof.

It is known in the art to provide a holster for engaging a bar gun, typically for encircling the nozzle of a bar gun, when the bar gun is not in use. The use of a holster, with a nozzle opening dimensioned slightly larger than the nozzle of a typical bar gun, allows the bar gun user to "holster" or place the bar gun in a non-use position, in much the same way the holster of a handgun will engage at least a portion of the barrel and leave the handle exposed, for use by the wearer.

Unlike handgun holsters, however, bar gun holsters are typically mounted to a rigid support surface, such as a sink, table or underside of a bar. Typical prior art bar gun holders include a mounting plate for engaging screws, which screws would be threaded into the underside of a support surface, and typically include a surround portion or bar gun nozzle receiving portion which extends laterally spaced away from the underside of the support surface.

Typical bar gun holsters may also include a pan portion spaced apart from the surround or nozzle opening portion, which pan member is designed to receive liquids that may drip off the end of the bar gun nozzle. That is to say, when a bartender is finished dispensing a drink, they will typically holster the nozzle of the bar gun and, even though the bartender may have finished dispensing the drink, there may still be fluid dripping from the nozzle. When the bar gun is holstered, the fluid may leak into the pan.

Bar gun holsters have included removable drain portions, separate from the mounting plate, for ease of washing and clean-up. These drain portions may include a lower drain opening and an upper perimeter. A drain hose is in fluid communication with the drain portion for carrying away waste fluid in a drain line.

Among advantages of Applicants' novel holster assembly set forth herein is the ability to maintain the bar gun nozzle tip sufficiently spaced apart from a base or bottom of a drain pan so as to prevent contamination of the removed end of the nozzle by fluid accumulating in the pan of the holster assembly.

Another advantage of Applicants' novel holster assembly is structure to adapt a large drain tube thereto, typically ½ inch ID or greater, which helps prevent backup into the pan of the assembly.

Another advantage of Applicants' novel holster assembly is a multi-piece assembly that toollessly and removably couples to a support base or mounting plate, allowing the portions of the holster assembly that may be contaminated, to be easily removed from the mounting plate and washed, even while the drain hose remains attached to an uncontaminated portion of the assembly.

Applicants further provide a holster assembly for a bar gun having a holster portion for receiving a nozzle of a bar gun, with a gap or space between the nozzle and the bar at the nozzle receiving member.

That is to say, Applicants provide a novel holster assembly that largely avoids contamination of a nozzle and a holster assembly that may be toollessly removed from the mounting plate for easy washing.

While prior art holsters have certain advantages, Applicants provide these advantages with other advantages in a novel bar gun assembly.

OBJECT OF THE INVENTION

It is the object of Applicants' novel holster assembly for a bar gun to provide a convenient, sanitary, easy to use, and easily cleaned bar gun assembly for use with the bar gun having a nozzle.

SUMMARY OF THE INVENTION

Applicants achieve the advantages and objects set forth herein by providing a multi-piece assembly that may be easily assembled and disassembled without the use of tools.

Applicants further achieve the advantages and objects set forth herein and others by providing a three-piece assembly, including: a mounting plate, a holster, and a drain body. The drain body and holster slideably engage one another and are easily uncoupled (without the use of tools) for washing. The assembled or coupled sub-unit defining the drain body and the holster is slidably mounted to a mounting plate, which is in turn mounted by fasteners to a support surface, such as the underside of a table or bar.

Another object is provided in Applicants' novel holster and drain assembly that includes a pan portion, which is spaced apart from a nozzle receiving member so that a nozzle, nested in the nozzle receiving member has its tip spaced apart from the pan. The pan includes, at an upper surface thereof, an upper drain portion or opening to ensure that no fluid is accumulated in the pan above the fluid level of the upper drain portion and therefore to the level of the nozzle tip.

BRIEF DESCRIPTION OF THE DRAWINGS

FIG. 4 with the bar gun in place, and FIG. 5 with the bar gun removed therefrom.

DETAILED DESCRIPTION OF THE PREFERRED EMBODIMENT

Figure 1:
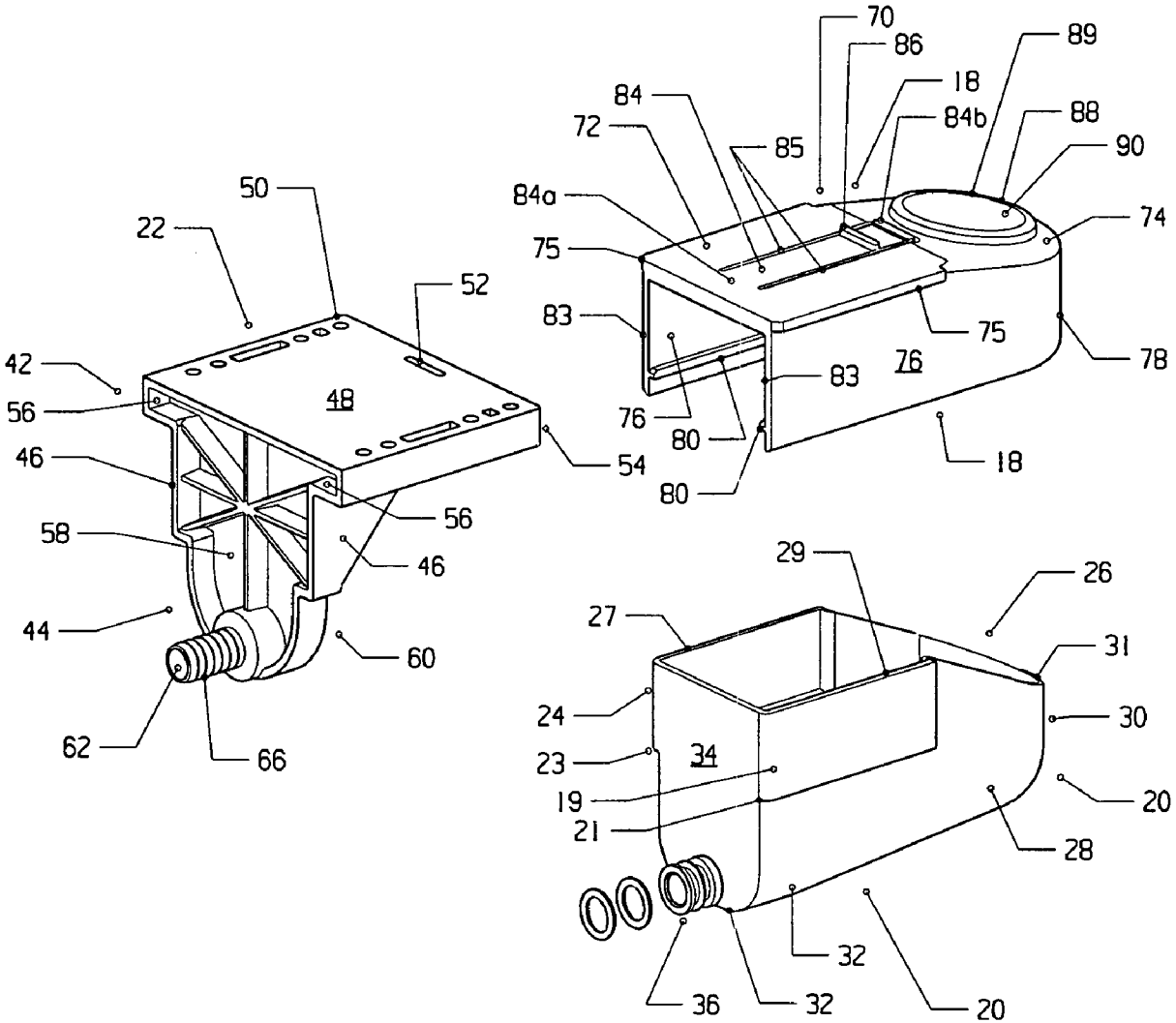
FIG. 1 illustrates an exploded perspective view of Applicants' novel holster and drain assembly.
Figure 3:
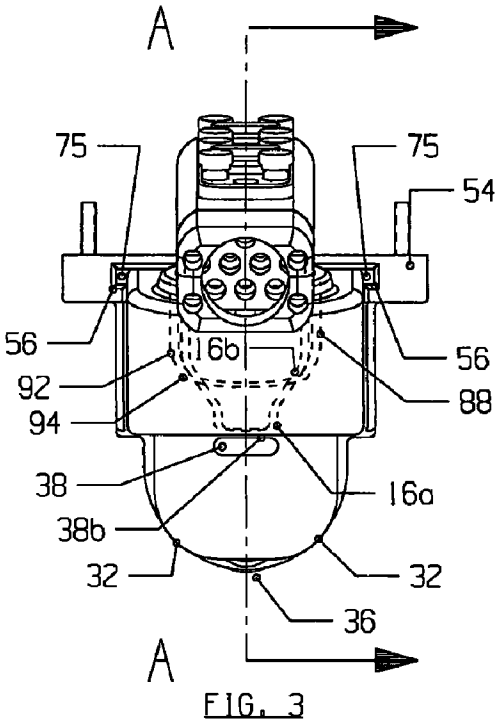
FIG. 3 includes a front elevational view of Applicants' novel holster and drain assembly with a bar gun engaged therewith.
Figure 2A:
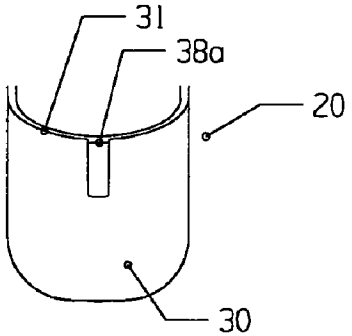
FIG. 2A is a partial view of an alternate embodiment of an upper drain opening.
Figure 2:
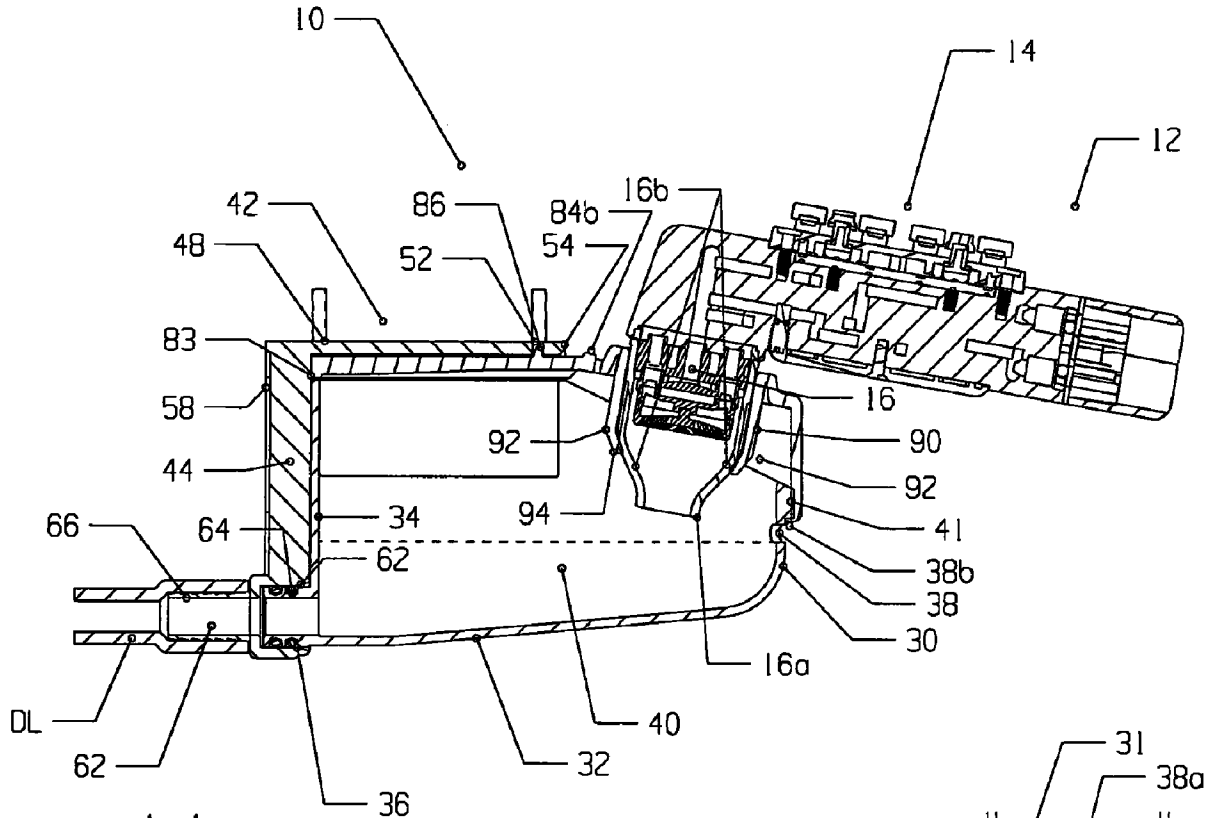
FIG. 2 illustrates a cross-sectional cutaway view of Applicants' novel holster and drain assembly with a bar gun engaged therewith.

FIGS. 1-3 disclose various embodiments of Applicants' novel holster and drain assembly 10. Holster and drain assembly 10 is seen to engage a bar gun 12 as is known in the art, the bar gun having a handle portion 14 and a nozzle portion or nozzle 16. As seen in FIGS. 2 and 3, the cylindrical nozzle portion of bar gun 12 is seen to engage the holster and drain assembly 10 through receipt into a mounting surround structure.

Applicants' novel structure achieves several advantages. It may be seen that Applicants' holster and drain assembly 10 includes a holster portion or a holster 18 for engaging a drain body 20 and a mounting plate 22. More specifically, the Figures illustrate the manner in which Applicants' holster and drain assembly or assembly 10 may be comprised of three pieces, with the mounting plate 22 mounted to a support surface, a subassembly comprising of the holster 18 and the drain body 20, which subassembly is toollessly and removably assembled, and which can be removed from mounting plate 22 for subsequent cleaning.

Put another way, Applicants provide a sub-assembly comprising a holster and drain body, which are joined together, the two elements joined slideably without tools to a mounting plate. Applicants' drain body and holster may then be disassembled and separately washed separately. Typically, the drain body portion 20, which includes a pan portion 40 for receipt of extraneous liquids dripping from the holster nozzle, will need to be cleaned. Easy and slideable disassembly from the holster and mounting plate facilitates such ease of washing. Further details of Applicants' novel assembly 10 may be appreciated with reference to the foregoing description.

Turning first to drain body 20, it is seen from the Figures to be in an integral body having land portions 19 and 24 laterally spaced apart from one another, which land portions have lower edges 21 and 23. Drain body 20 is seen to have walls defining an upper edge 26, which upper edge may include upper edges 27 and 29 of the land portions 19 and 24, as well as upper edge 31 of curved front wall 30.

Applicants' drain body 20 typically includes a pair of spaced apart sidewalls 28, which sidewalls join land portions 19 and 24, and which sidewalls curve and define the curved front wall 30.

Applicants' drain body 20 includes a curved bottom wall 32 and a flat rear wall 34. At the bottom of rear wall 34 is lower drain channel 36. Part of curved front wall 30 includes overflow opening 38. An imaginary horizontal line drawn between the lower edge of overflow opening 38 extending across drain body 20 to rear wall 34 defines an imaginary line below which the pan portion 40 of drain body 20 exists, to receive fluids dripping from nozzle tip 16*a*, as best seen in FIG. 2. It is also seen in FIGS. 2 and 2A that upper drain opening may be defined by either an opening surrounded by walls (enclosed) or shaped like a slot 38A extending below upper edge 31. An opening will refer to either configuration.

Bottom wall 32 typically is angled downward from curved front wall 30 to lower drain channel 36, such that fluid accumulated in the pan will flow to lower drain channel 36. Moreover, with reference to FIG. 3, it is seen that bottom wall 32 is curved on either side to direct fluid flow in pan portion 40 to lower drain channel 36.

Turning now to Applicants' mounting plate 22, it is seen to be generally comprised of a horizontal tabular portion 42 integral to and joined with a vertical portion 44, the two portions which may be braced by a pair of laterally spaced apart diagonal brace portions 46. Turning now to tabular portion 42, it is seen that tabular portion 42 comprises an upper wall 48, which is typically the uppermost part of assembly 10, which upper wall 48 is flat so as to fit flush against the underside of the support surface. A multiplicity of fastener holes 50 are provided in the upper wall for receipt of fasteners, such as screws therethrough, to fixedly and rigidly maintain tabular portion and mounting plate 22 to a support surface. Upper wall 48 is also seen to include retainer slot 52 (FIG. 2), which can releasably lock an engagement means of the holster member 18 as set forth in more detail below. Tabular portion 42 further includes a front wall 54, which front wall 54, as best seen in FIG. 3, includes walls defining a pair of receiving channels or slots 56, which are dimensioned to receive support legs 75 of holster member 18 as seen in FIGS. 1 and 3.

Vertical portion 44 of mounting plate 22 includes a front wall 58, including a lower portion 60, the lower portion including a channel 62 therein. Channel 62 has a drain member portion 66 that typically extends rearward from vertical portion 44 (that is to say, opposite from the tabular portion 42, which extends forward from the upper portion of vertical portion 44). Channel 62 has an ID of typically ⅜ inch or greater to avoid clogging (one actual ID may be 0.425"). Drain member portions 66 of channel 62 is adapted to receive a drain line DL thereon. Channel 62 joins a lower drain channel receiving portion 64, which has an outer diameter slightly larger than channel 62, which outer diameter is dimensioned to receive lower drain channel 36 of drain body 20 therein. Typically a few O-rings are located between lower drain channel 36 (outer walls) and the walls defining lower drain channel receiving portion 64 for a fluid tight couple. Channel 62 includes a drain member portion 66 acting to receive a drain line DL extending outward and rearward from lower member 60, which channel 62 also includes a lower drain channel receiving portion 64, as best seen in FIG. 2, for coupling, here, fluid tight and telescopically, with lower drain channel 36 of drain body 20.

Turning now to holster member or holster 18, it may be seen with reference to the Figures that holster member includes a top wall 70 typically having a tabular or flat portion 72 designed to slideably receive and lay flush against the underside of upper wall 48 when the two parts are joined and in use as seen in FIG. 2. Top wall 70 is also seen to have a pair of parallel, laterally spaced apart, outwardly extending support legs 75, which are designed and dimensioned to slideably engage the paired spaced apart parallel receiving slots 56 of tabular portion 42 on mounting plate 22 (see FIG. 3). Top wall 70 may also include an angled portion 74 in one embodiment, details of which will be further discussed and set forth below.

Holster member 18 includes a pair of sidewalls 76 depending from top wall 70. Sidewalls 76 curve and join to define a nose portion 78 which may bear a similar curve, though a larger radius of curvature, when compared to curved front wall 30 of drain body 20.

A pair of spaced apart parallel leg members 80 extend inward from the lower portion of sidewalls 76 to slideably receive lower edges 21 and 23 of land portions 19 and 24 of drain body 20. Holster member 18 will slideably receive drain body 20 through sliding engagement wherein lower edges 21 and 23 track along leg members 80 and upper edges 27/29 slide along the underside of top wall 70 until bumper 41 (optional) or the most removed part of curve on front wall 30 of drain body 20 strikes inner wall of curved nose 78 of holster member as seen in FIG. 2. When such contact is made, it will be seen that rear wall 34 will be generally flush with rear perimeter edge 83 of holster member as seen in FIG. 2. The two will typically lay flush against front wall 58 of mounting plate 22 when the subassembly 18/20 is coupled to mounting plate 22 as seen in FIG. 2.

Turning back to top wall 70, it is seen that a biased or flexible retainer member 84 may be provided with a near end 84*a* integral with and attached to top wall 70, and a removed end 84*b*, which is free to be depressed. Depressing may release a raised locking tab 86 near the removed end from an engaged position with retainer slot 52 of mounting plate 22. Channels 85 on either side of retainer member 84 separate the retainer member from the top wall 70, such that the only place the retainer member joins the top wall is at near end 84*a*. The removed end 84*b*, since the retainer member 84 is typically a resilient plastic, is capable of flexing. Pressing gently downward at free removed end 84*b* will allow uncoupling of the locking tab 86 when it resides in slot 52 as seen in FIG. 2. This allows removal of the holster member from the mounting plate. Moreover, the holster member slideably couples to the drain body. The drain body is typically not lockingly engaged to the mounting plate, but has walls that "telescope" into the holster, which holster in turn locks to the mounting plate. The sub-assembly defined by the holster member and drain body will be removed (without the use of tools) from the mounting plate and be received onto the mounting plate utilizing the retainer member 84 with locking tab 86 coupling/uncoupling with retainer slot 52 of the mounting plate.

Turning again to holster member 18, structure is defined and set forth herein, which structure provides a function of receiving the nozzle of a bar gun in a manner which maintains the removed or furthermost end 16*a* of the nozzle at least above pan portion 40. Structure provided by Applicants' novel holster member includes cylindrical nozzle receiving member 88 typically provided in the angled portion 74 of the top wall. Nozzle receiving member 88 may include upper lip 89. Inner walls 90 of nozzle receiving member 88 may include an annular shoulder portion 92 above a lip 94. The lip 94 may define an opening for accommodating the removed end of the nozzle and the annular shoulder portion 92 being dimensioned according to the distance between a corresponding shoulder 16*b* of a nozzle. That is to say, nozzle receiving member 88 is dimensioned to receive a nozzle. Annular shoulder 92 receives shoulder 16*b* of the nozzle such that, and according to the distance between shoulder 16*b* of nozzle and removed end 16*a* of nozzle, the removed end 16*a* of nozzle will stay at least above the imaginary line below which defines the pan portion 40 (dash line in FIG. 2) and preferably above a horizontal line across drain body 20 defined by upper portion or upper edge 38*b* of overflow opening 38. With such a dimension, for example, ⅛-1 inch, a bartender viewing overflow opening 38, located as it is below nose 78 and below the nozzle, would notice any accumulated leakage from the pan portion and be able to remove it from the mounting member and wash it. Moreover, the geometry of nozzle receiving member 88, the nozzle, and the pan portion 40 (dash line in FIG. 2), dictate the nozzle should not rest in any accumulated, and potentially contaminating, fluid accumulated in the pan (as, for example, if the drain is clogged). It is to be noted that any nozzle engaging member may be provided on holster 18 to engage the bar gun to maintain the nozzle fully seated in the nozzle receiving member 88, but with its removed end above the pan portion.

Structure for retaining the removed end of the nozzle above the lower lip of the overflow opening may include locating lip 94 so that its distance above pan portion 40 is greater than the distance of the nozzle (to be used with the holster) that the nozzle extends beyond the lip. In other words, the tip of the nozzle will be maintained above the pan portion 40. In an alternate preferred embodiment, the removed end of the nozzle will be maintained at or above the upper edge 386 of the overflow opening (see FIG. 3). A second structure that may be provided that will maintain the removed end of the nozzle above at least the pan portion or an alternate preferred embodiment above the upper edge of the overflow opening would be to set the dimension between lip 89 and either of the pan portion or the upper edge of the overflow opening such that when the bar gun rests fully seated in the nozzle receiving member 88, the juncture of the bar gun nozzle and the handle rests on lip 89 such that the removed end of the nozzle is set properly. That is to say, in FIG. 2, it can be seen that, if there were no lip 94, the nozzle could be inserted all the way into the nozzle receiving member until the junction of the handle to the nozzle stops such motion. In such a case, even without a lip, the dimension of the assembly may set the removed end of the nozzle in the proper position.

A typical clearance that has worked well to maintain a cylindrical nozzle in the cylindrical nozzle receiving member is about 0.012 inch, range about 0.003-0.070, optimum 0.005-020, preferably the nozzle receiving member is non-elastomeric and may be a rigid plastic, such as ABS. Generally, a clearance fit will have a lower end of about 0.003, the upper range could exceed 0.070, and still achieve the benefits of a clearance fit. That is to say, there should be sufficient clearance between the outer diameter of the bar gun nozzle and the inner diameter of the nozzle receiving member. However, if there is too great a clearance, the nozzle will not stay firmly attached and may work its way out with repeated jostling and nudging.

Typically, extraneous fluid from the nozzle would simply drain out by running down bottom wall 32 (inclined as seen in FIG. 2) and out to drain line DL. However, should channels 62 and 36 become clogged or the drain line itself becomes clogged, then fluid may accumulate in the pan portion 40. Regardless of the fluid accumulation, however, it should not rise above pan portion 40, as it would then drain out overflow opening 38 (and be visible to a user). Overflow opening is located spaced outward from holster receiving member 88 so as to be easily viewed by the bartender.

Figure 4:
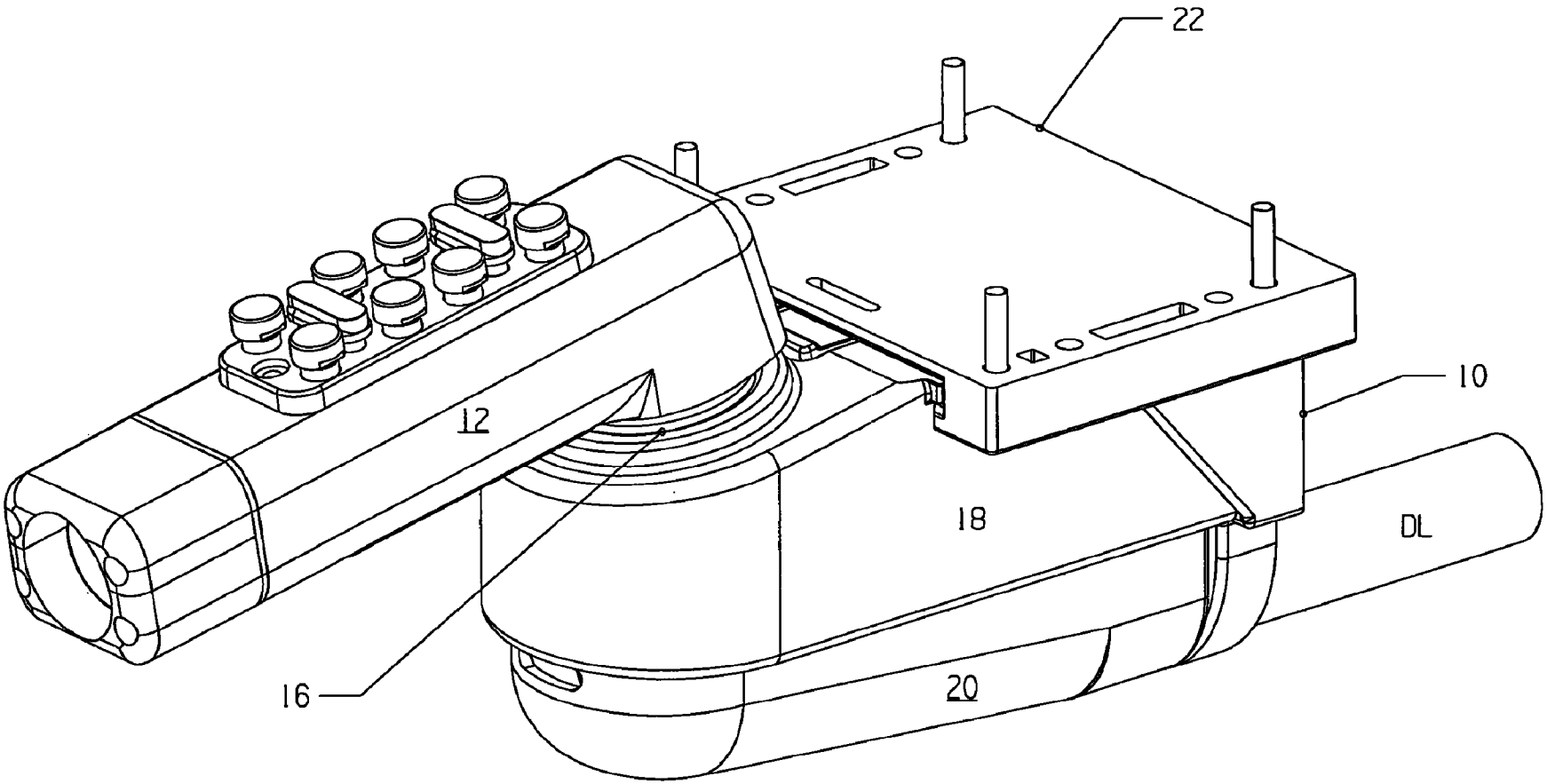
FIGS. 4 and 5 are front perspective views of Applicants' novel holster and drain assembly.
Figure 5:
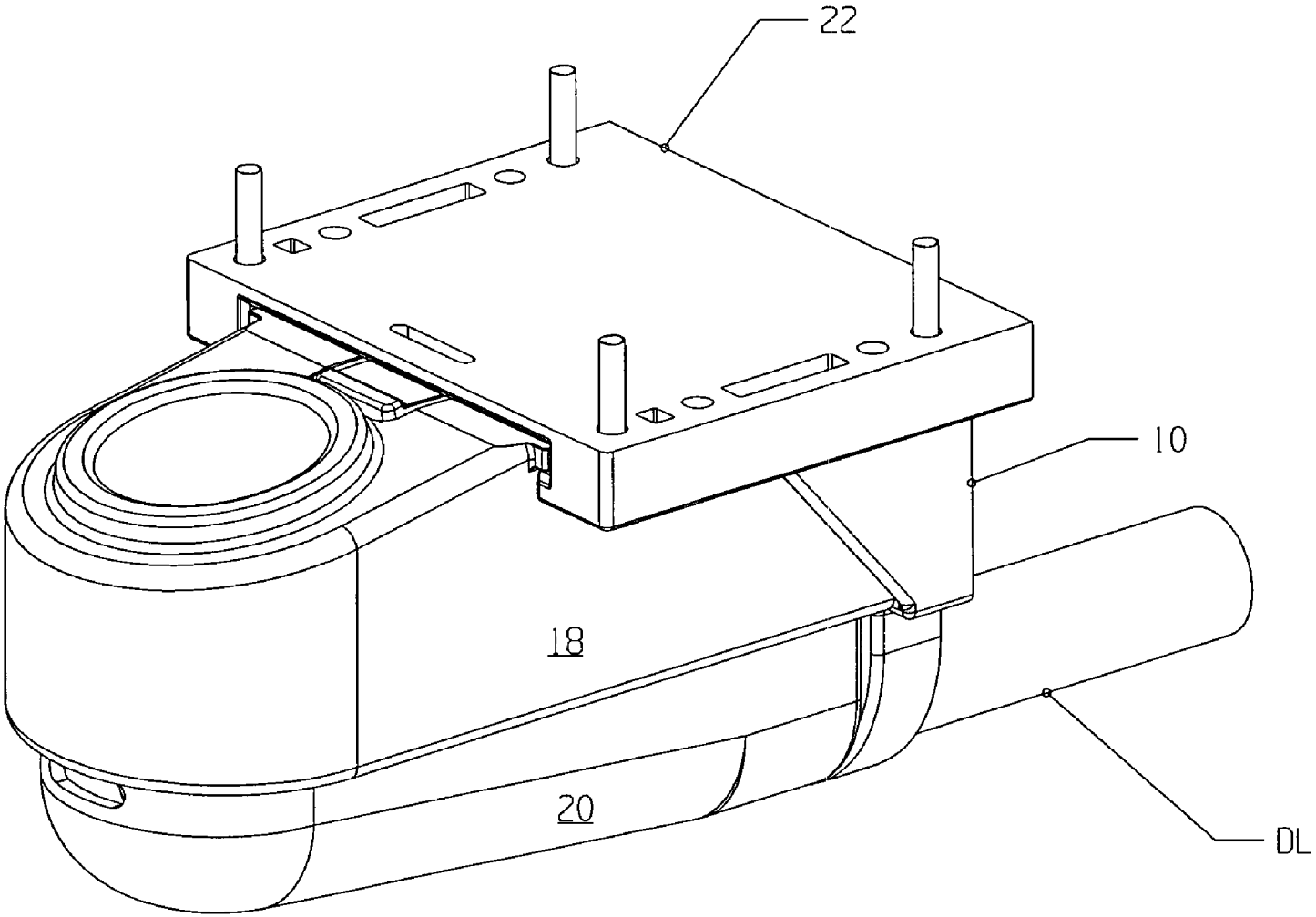

FIGS. 3, 4, 5, and 6 illustrate the assembly set forth above and parts thereof. FIGS. 4 and 5 illustrate an external view of Applicants' novel holster assembly for a bar gun. In FIG. 4, it is seen how the nozzle of the bar gun will rest in the assembly and the manner in which the assembly may mount to the underside of a support surface. Moreover, FIG. 4 illustrates that the fluid level in the pan portion, if any, as accumulated may be viewed through the upper drain opening (visible in FIG. 4).

FIG. 5 illustrates the same view as FIG. 4, except with the bar gun removed and details of the sliding mechanism as well as the releasably retaining mechanism may be appreciated that allow the sub-assembly of the drain body and holster member to slide on and off a mounting surface, easily and without tools, for disassembly and washing.

Figure 6:
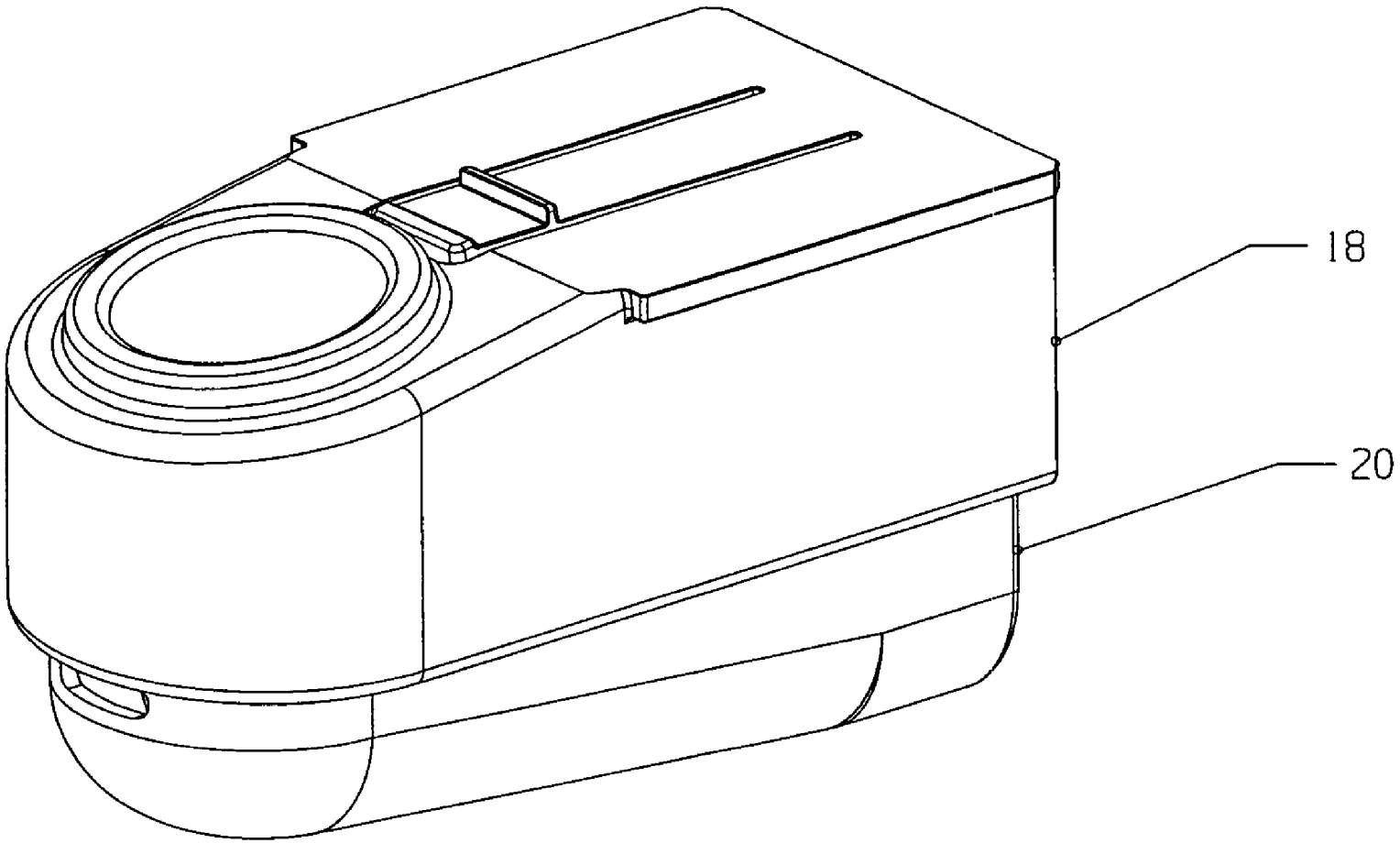
FIG. 6 is an illustration of Applicants' novel holster and drain assembly without the mounting plate, but illustrating the manner in which the holster and drain body engage one another as a subassembly.

FIG. 6 illustrates the sub-assembly formed by the holster member and the drain body as it is ready for receipt onto the mounting member.

Figure 7:
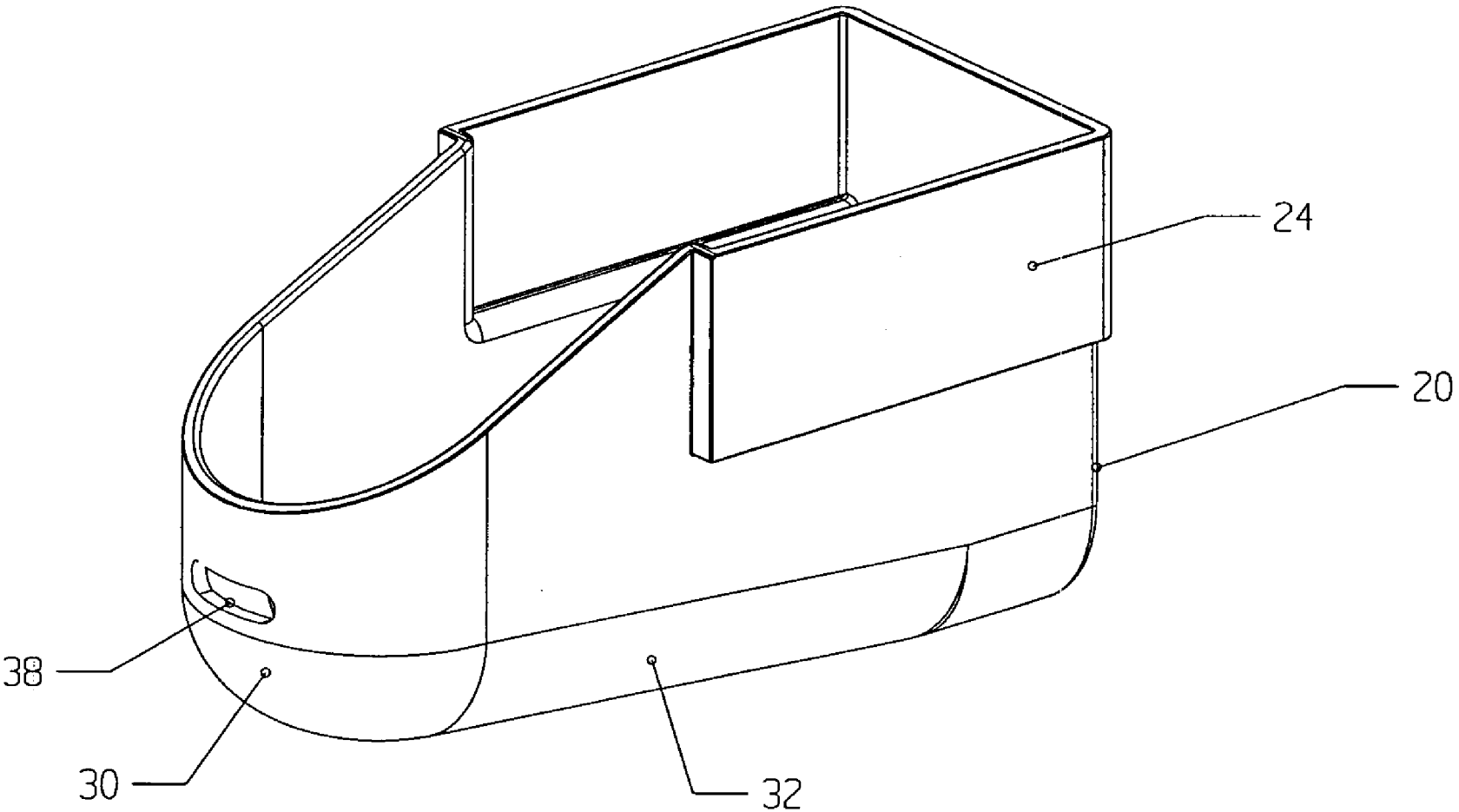
FIG. 7 is a perspective view of the drain body.

FIG. 7 illustrates the drain body apart from the rest of the assembly and the manner in which the drain body is configured to receive excessive waste fluid and remove it from the pan portion through the lower drain channel. If there is blockage or other accumulation, the drain body will allow such excess fluid above the pan portion to drip out of the upper drain opening.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. A holster and drain assembly for engaging a bar gun, the bar gun having a handle and a nozzle having a removed end, the holster and drain assembly for engaging a mounting surface and a drain line, the holster and drain assembly comprising:

a holster portion dimensioned to receive the nozzle;

a drain body having an upper perimeter and a lower drain opening and having a drain member extending therefrom, the lower drain opening for draining fluids from the nozzle, an overflow opening for draining fluids accumulating from clogging downstream of the lower drain opening;

a mounting plate for mounting the holster portion and drain body to a support surface;

wherein the holster portion includes walls which toollessly and slideably couples with the drain body.

2. The holster and drain assembly of claim 1, wherein the holster portion engages the nozzle such that the removed end is above the upper perimeter of the drain body.

3. The holster and drain assembly of claim 1, wherein the drain body couples to the mounting plate without the use of tools.

4. The holster and drain assembly of claim 1, wherein the holster portion and the drain body releasably lock to the mounting plate without the use of tools.

5. The holster and drain assembly of claim 1, wherein the holster portion includes a flexible retainer member and the mounting plate includes a retainer slot dimensioned for removably engaging the flexible retainer member therein.

6. The holster and drain assembly of claim 1, wherein the drain body includes walls that slideably engage the holster portion for tooless coupling thereto.

7. The holster and drain assembly of claim 1, wherein the holster portion includes a flexible retainer member and the mounting plate includes a retainer slot dimensioned for removably engaging the flexible retainer member therein, and wherein the drain body includes walls that slideably engage the holster portion for coupling thereto.

8. The holster and drain assembly of claim 1, wherein the mounting plate is comprised of a horizontal surface including walls to engage and support the weight of the holster portion and the support the weight of the drain body.

9. The holster and drain assembly of claim 1, wherein the mounting plate includes mounting channels therein, and wherein the holster portion includes walls dimensioned to toolessly, slideably engage the mounting channels of the mounting plate.

10. The holster and drain assembly of claim 9, wherein the holster portion includes drain body receiving walls and wherein the drain body includes walls dimensioned to slideably, toolessly engage the holster portion.

11. The holster and drain assembly of claim 1, wherein the drain body includes an upper edge above the overflow opening, a pan portion below the overflow opening, and wherein the holster portion engages the nozzle such that the removed end of the nozzle is below the upper edge and above the pan portion.

12. The holster and drain assembly of claim 1, wherein the drain body includes a drain member defining the lower drain opening, and wherein the mounting plate includes a drain member defining a drain opening, and wherein the drain member of the mounting plate and the drain body are adapted to engage in fluid tight coupling.

13. The holster and drain assembly of claim 12, wherein the drain member of the mounting plate is adapted to receive a drain line with at least approximately ½ inch interior diameter.

14. The holster and drain assembly of claim 12, wherein the two drain members telescopically engage one another.

15. The holster and drain assembly of claim 1, wherein the drain body is sandwiched between the mounting plate and the holster portion.

16. A holster and drain assembly for engaging a bar gun, the bar gun having a handle and a nozzle having a removed end, the holster and drain assembly for engaging a mounting surface and a drain line, the holster and drain assembly comprising:

a mounting plate; and a drain body and holster portion subassembly;

wherein the drain body and holster portion subassembly includes separate drain body and holster portions and wherein the drain body and holster portions of the drain body and holster portion subassembly include walls adapted to toolessly engage and couple one another; and wherein the subassembly is adapted, when the drain body and holster portion are coupled to one another, to toolessly and releasably couple with the mounting plate.

17. The holster and drain assembly of claim 16, wherein the drain body has an overflow opening and a lower drain opening.

18. The holster and drain assembly of claim 16, wherein the holster portion and drain body couple to mounting plate without the use of tools.

19. The holster and drain assembly of claim 16, wherein the holster portion and drain body subassembly are made from hard plastic.

20. The holster and drain assembly of claim 16, wherein the holster portion includes wall portions that engage in a sliding fit with walls of the drain body to toolessly couple the holster portion to the drain body.

21. The holster and drain assembly of claim 16, wherein the drain body includes an overflow opening and an upper edge above the overflow opening, a pan portion below the overflow opening, and wherein the holster portion engages the nozzle located in the holster portion such that the removed end of the nozzle is above the pan portion.

22. The holster and drain assembly of claim 16, wherein the drain body includes a drain member defining a lower drain opening, and wherein the mounting plate includes a drain member defining a drain opening, and wherein the drain member of the mounting plate and the drain body are adapted to engage in fluid tight coupling.

23. The holster and drain assembly of claim 16, wherein the drain body includes a lower drain opening and further includes walls adapted to allow overflow of liquid accumulating therein, the walls below a nozzle seated in the holster portion.

24. A holster and drain assembly for engaging a bar gun, the bar gun having a handle and a nozzle having a removed end, the holster and drain assembly for engaging a mounting surface and a drain line, the holster and drain assembly comprising:

a mounting plate, a mounting plate having a drain member extending at least partially in a first direction therefrom, said drain member for coupling with a drain line;

a holster portion;

a drain body, wherein the drain body has a drain member extending at least partially therefrom, the drain member of said drain body extending in a first direction such that the drain members of the drain body and mounting plate are adapted to join in a fluid tight coupling when the drain body is engaged to the holster portion and the holster portion is engaged to the mounting plate.

25. The holster and drain assembly of claim 24, wherein the drain body includes an overflow opening and wherein the holster portion engages the nozzle seated therein such that the removed end of the nozzle is above the overflow opening of the drain body.

26. The holster and drain assembly of claim 24, wherein the holster portion and the drain body couple to the mounting plate without the use of tools.

27. The holster and drain assembly of claim 24, wherein the holster portion and the drain body releasably lock to the mounting plate without the use of tools.

28. The holster and drain assembly of claim 24, wherein the holster portion includes wall portions that engage in a sliding fit with walls of the drain body to toolessly couple the holster portion to the drain body.

29. The holster and drain assembly of claim 24, wherein the drain body includes an upper edge above the overflow opening, a pan portion below the overflow opening, and wherein the holster portion engages the nozzle located in the holster portion such that the removed end of the nozzle is above the pan portion.

30. The holster and drain assembly of claim 24, wherein the drain body includes a lower drain opening and further includes walls adapted to allow the overflow of liquid accumulating therein, the walls below the nozzle seated in the holster portion.

31. A holster and drain assembly for use with a bar gun having a handle portion and a nozzle portion, the nozzle portion having a near end attached to the handle and a removed end from which a fluid may issue, the assembly comprising:

a mounting plate;

a drain body having an upper perimeter, a lower drain opening, and an overflow opening with an upper and a lower edge; and a holster portion with a nozzle receiving member having an open upper end for receiving at least a portion of the nozzle and an open lower end, the nozzle receiving member including walls adapted to engage the nozzle such that the removed end of the nozzle is above the lower edge of the overflow opening.

32. The holster and drain assembly of claim 31, wherein the holster portion and the drain body couple to the mounting plate without the use of tools.

33. The holster and drain assembly of claim 31, wherein the holster portion and the drain body releasably lock to the mounting plate without the use of tools.

34. The holster and drain assembly of claim 31, wherein the holster portion includes wall portions that engage in a sliding fit with walls of the drain body to toolessly couple the holster portion to the drain body.

35. The holster and drain assembly of claim 31, wherein the drain body includes a pan portion below the overflow opening, and wherein the holster portion engages the nozzle such that the removed end of the nozzle is below the upper perimeter of the drain body and above the pan portion.

36. The holster and drain assembly of claim 31, wherein the drain body includes a drain member and a lower drain opening, and wherein the mounting plate includes a drain member and a drain opening, and wherein the drain member of the mounting plate and the drain body are adapted to engage in fluid tight coupling.

37. A holster and drain assembly for use with a bar gun having a handle portion and a nozzle portion, the nozzle portion having a near end attached to the handle and a removed end from which a fluid may issue, the assembly comprising:

a mounting plate;

a drain body; and a holster portion with a cylindrical nozzle receiving member having an inner diameter for receiving at least a portion of a cylindrical nozzle, the nozzle having an outer diameter, the nozzle having a clearance fit with the nozzle receiving member of the holster portion; and wherein the difference between the two diameters is in the range of 0.003" to 0.070".

38. The holster and drain assembly of claim 37, wherein the drain body has an overflow opening and wherein the holster portion engages the nozzle such that the removed end of the nozzle is above the overflow opening of the drain body.

39. The holster and drain assembly of claim 37, wherein the holster portion and drain body couple to the mounting plate without the use of tools.

40. The holster and drain assembly of claim 37, wherein the holster portion and drain body releasably lock to the mounting plate without the use of tools.

41. The holster and drain assembly of claim 37, wherein the holster portion includes wall portions that engage in a sliding fit with walls of the drain body to toolessly couple the holster portion to the drain body.

42. The holster and drain assembly of claim 37, wherein the drain body includes an overflow opening and an upper edge above the overflow opening, a pan portion below the overflow opening, and wherein the holster portion engages the nozzle such that the removed end of the nozzle is above the pan portion.

43. The holster and drain assembly of claim 37, wherein the drain body includes a drain member and a lower drain opening, and wherein the mounting plate includes a drain member and a drain opening, and wherein the drain member of the mounting plate and the drain body are adapted to engage in fluid tight coupling.

44. The holster and drain assembly of claim 37, wherein the difference between the two diameters is at least about 0.003 inches.

45. A holster and drain assembly for engaging a bar gun, the bar gun having a handle and a nozzle having a removed end, the holster and drain assembly for engaging a mounting surface and a drain line, the holster and drain assembly comprising:

a holster portion dimensioned to receive the nozzle;

a drain body having an upper perimeter and a lower drain opening and an overflow opening above the lower drain opening and below the upper perimeter and a pan portion below the overflow opening and having a drain member extending therefrom, the lower drain opening for draining fluids from the nozzle, the overflow opening for draining fluids accumulating from clogging downstream of the lower drain opening;

a mounting plate for mounting the holster portion and drain body to a support surface;

wherein the holster portion engages the nozzle such that the removed end is above the overflow opening of the drain body;

wherein the holster portion and the drain body releasably, lockingly couple to the mounting plate without the use of tools;

wherein the mounting plate includes mounting channels therein, and wherein the holster portion includes walls dimensioned to slideably engage the mounting channels of the mounting plate;

wherein the holster portion is adapted to engage the nozzle such that the removed end of the nozzle is below the upper perimeter and above the pan portion;

wherein the drain body includes a drain member defining the lower drain opening, and wherein the mounting plate includes a drain member defining a drain opening, and wherein the drain member of the mounting plate and the drain body are adapted to engage in fluid tight coupling; and wherein the nozzle receiving member of the holster portion has a clearance fit with the nozzle, the clearance fit being in the range of about 0.003 inches to 0.070 inches.

* * * * *